US005742958A

United States Patent [19]

Solazzo

[11] Patent Number: 5,742,958

[45] Date of Patent: Apr. 28, 1998

[54] INFLATABLE PATIENT TRANSFER ROLLER MATTRESS

[76] Inventor: Anthony Solazzo, 904 Oak Tree Rd., South Plainfield, N.J. 07080

[21] Appl. No.: 820,113

[22] Filed: Mar. 19, 1997

Related U.S. Application Data

[63] Continuation-in-part of Ser. No. 623,912, Mar. 28, 1996, abandoned.

[51] Int. Cl.[6] ..... A61G 7/08; A61G 7/10

[52] U.S. Cl. ..... 5/81.1 R; 5/81.1 HS

[58] Field of Search ..... 5/81.1 R, 81.1 C, 5/81.1 HS, 81.1 T, 706, 715

[56] References Cited

U.S. PATENT DOCUMENTS

| | | | |
|---|---|---|---|
| 4,051,565 | 10/1977 | Berge | 5/81.1 C |
| 4,272,856 | 6/1981 | Wegener et al. | 5/81.1 R |
| 4,517,690 | 5/1985 | Wegener | 5/81.1 R |
| 4,528,704 | 7/1985 | Wegener et al. | 5/81.1 R |
| 4,686,719 | 8/1987 | Johnson et al. | 5/81.1 R |
| 4,944,053 | 7/1990 | Smith | 5/81.1 C |
| 5,005,232 | 4/1991 | Wright et al. | 5/81.1 C |
| 5,067,189 | 11/1991 | Weedling et al. | 5/81.1 R |

OTHER PUBLICATIONS

Microtek Medical, Inc., "Transfer-Ease Patient Transfer Sheet", 1993.

*Primary Examiner*—Alexander Grosz
*Attorney, Agent, or Firm*—Kenneth P. Glynn, Esq.

[57] ABSTRACT

An inflatable patient transfer roller mattress is described for moving a patient from a first platform to a second platform. It includes a top sheet and a bottom sheet capable of being selectively sealed together, a set of parallel inflatable rollers and at least a pair of manifolds. Each roller has a pair of necked-down ends for introduction of an inflation gas, the rollers being formed by sealing selected areas of the top sheet and the bottom sheet together. The opposing, inflatable manifolds are for delivery of an inflation gas to each roller, and each manifold is disposed adjacent to and in gaseous contact with each necked-down end of the rollers, the manifolds being formed by sealing selected areas of the top sheet and the bottom sheet together.

15 Claims, 4 Drawing Sheets

INFLATABLE PATIENT TRANSFER ROLLER MATTRESS

REFERENCE TO RELATED APPLICATION

This application is a continuation-in-part of U.S. patent application Ser. No. 08/623,912, filed on Mar. 28, 1996 and entitled "Inflatable Patient Transfer Mattress" now abandoned. Disclosure Document No. 401262 was filed on Jun. 4, 1996 entitled "Inflatable Patient Transfer Roller".

BACKGROUND OF THE INVENTION

1. Field of the Invention

The present invention relates in general to inflatable roller mattresses used for the transportation of patients from one platform to another. More specifically, the present invention is directed to an inflatable patient transfer mattress having a plurality of inflatable rollers to roll an item being transferred.

2. Information Disclosure Statement

The transfer of a patient from one platform to another has always been a difficult procedure for hospital and other personnel, such movement of patients from an incoming stretcher to an operating table or to a hospital bed.

The following patents are examples of air-bearing patient devices which have attempted to move patients from one area to another.

U.S. Pat. No. 4,051,565 issued to Berge describes a mat conveyor which is an open-ended, flexible tube-like member having flexible walls which collapse together to form a conveyor. The mat can be laminar in structure with an outer layer of tough flexible material which may include cushioning material and an inner layer of a material having a low coefficient of friction. The conveyor is placed next to the patient and the portion of the patient adjacent the conveyor is lifted onto the conveyor. Two faces of the inner low friction layer are thus in contact and the patient can be transferred, with the conveyor acting as a tank tread, to the new resting location.

U.S. Pat. No. 4,272,856 issued to Wegener et al describes a thin flexible film bag, oriented horizontally and having an absorbent material chuck on its upper wall, forms a plenum chamber. A lower wall underlies the chuck and includes small diameter perforations to create an air bearing to support the patient mover. Air enters the plenum chamber through an outer tube of thin, flexible material. A set of paired, opposed, flat and less flexible tongues define a short inner tube, being positioned within the outer tube, to permit airflow entry to the plenum chamber with the tongues being deflected away from each other. The tongues are pressed against each other and one side of the outer wall to prevent air escape from the chamber at that point. The patient lies on the chuck and can be readily moved in a frictionless manner when air under pressure fills the plenum chamber and escapes through the perforations.

U.S. Pat. No. 4,517,690 issued to Wegener describes an air pallet for frictionless movement of a load. The air pallet has top and bottom walls which define a plenum chamber, where at least the bottom wall is made of a thin flexible sheet material. The bottom wall has a portion, defined by the footprint of the load, having a plurality of closely spaced small diameter perforations opening directly into the plenum chamber. A constant air flow is maintained throughout the plenum chamber when the air pallet is under load at the time of air pressurization of the plenum chamber. Air inlets into the plenum chamber permit low pressure air flow into the plenum chamber for jacking the load and for subsequent discharge through the perforations, which in turn causes an air film between the bottom wall and the fixed support surface. A pair of flexible strips are interposed at laterally opposed inlets within the plenum chamber and extend across the chamber from opposed edges of the air pallet with the free ends of the strips overlapped. This insures that an used air inlet is sealed prior to pressurization of the plenum chamber.

U.S. Design Pat. No. 4,528,704 issued to Wegener et al shows an air pallet patient mover which is formed from top, intermediate and bottom thin flexible sheets of electrically conductive sheet material. The sheets are stitched with conductive thread to form a plenum chamber between the bottom and intermediate sheets and a semi-rigid backing member between the top and intermediate sheets. Completely sealed high pressure tubes formed from the top and intermediate sheets may constitute the backing member. Alternatively, the tubes may be low pressure tubes. Operationally, it works similar to the above patents.

U.S. Pat. No. 4,686,719 issued to Johnson et al describes an air pallet patient mover formed by top, intermediate and bottom thin flexible sheets sealed together about their edges and defining a plenum chamber between the intermediate and the bottom sheets. A backing member cavity is also formed between the top and intermediate layers, which may include therein a semi-rigid backing member. Operationally it is similar to the two patents discussed above. Foam strips are added in this version. They are placed within the plenum chamber and extends over a substantial lengthwise extent of the plenum chamber to insure air distribution within the plenum chamber. They are also added to provide padding and eliminate sharp edges which may interfere with x-rays.

U.S. Pat. No. 4,944,053 issued to Smith describes a disposable fabric device similar to the above having a first layer of a non-woven material having absorbent qualities and which is air permeable. A second layer of woven or synthetic relatively frictionless material is attached to the first layer as by sewing. Two such devices can be used together, with a first device placed on a bed or exam table woven side down, and a second device placed on top of the first, woven side up, such that the relatively frictionless layers are in contact. A patient placed on top of the two devices can move around more easily with this arrangement. Another way of using the invention is to double over one such device and fasten the ends such that the relatively frictionless layer contacts itself. The device is then used like the device in the first referenced patent.

U.S. Pat. No. 5,005,232 issued to Wright et al. describes a lubricated patient shifter pad formed of a sealed elongated flattened enclosure with angled ends. The enclosure is made of a air tight puncture resistant material and a small quantity of a lubricant and air are enclosed therein to reduce friction of opposing surfaces of the enclosure. The device is used in a similar manner to the above mentioned devices by rolling over itself in a tank tread type manner, the lubricant taking the place of the low friction materials used in other such devices. The angled corners of the device provide minimum hinderance to rolling the device.

U.S. Pat. No. 5,067,189 issued to Weedling et al describes an air pallet similar to the above but which incorporates side-to-side linked air-pressurized tubes in two integrated rows in place of the structure of the above patents. The linked tubes perform the function of the rigid backing members.

A patient transfer sheet from Microtek Medical, Inc., which is a plastic sheet having a slippery under surface. The sheet is placed on the platform, followed by the patient. After the operation, patient is transferred by pulling on the sheet. After transference, sheet is removed from underneath patient by tearing sheet along a perforated center.

United Kingdom Patent No. GB2159047A issued to Roisaeth and Ross describes a tubular carpet having an outside layer of fluid permeable cloth material, an inside layer of fluid tight, smooth cloth material, and an intermediate layer of fluid permeable filling material. The device has a replaceable cover to keep the carpet clean, the cover being autoclavable or disposable. The device works in a tank tread type manner to move a patient as previously described.

Notwithstanding the prior art, the present invention is neither taught nor rendered obvious thereby.

SUMMARY OF THE INVENTION

An inflatable patient transfer roller mattress is described for moving a patient from a first platform to a second platform. It includes a top sheet and a bottom sheet capable of being selectively sealed together, a set of parallel inflatable rollers and at least a pair of manifolds. Each roller has a pair of necked-down ends for introduction of an inflation gas, the rollers being formed by sealing selected areas of the top sheet and the bottom sheet together. The opposing, inflatable manifolds are for delivery of an inflation gas to each roller, and each manifold is disposed adjacent to and in gaseous contact with each necked-down end of the rollers, the manifolds being formed by sealing selected areas of the top sheet and the bottom sheet together. There is also at least one valve connected to at least one of the manifolds to permit inflation of the manifolds and the rollers to an inflated, semi-rigid state such that the manifolds maintain the rollers in a spaced parallel relationship and the rollers become round such that an item resting on the top sheet on a first platform is lifted by the rollers and during movement of the item from a first platform to a second platform, the rollers revolve about the necked-down portions, which portions act as rotational pivots which twist so as to minimize rolling resistance and seal the gas in the rollers for further rigidity thereof.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention involves an inflatable patient transfer roller mattress. It is used for moving patients from a first platform to a second platform. By "platform" is meant any substantially horizontal surface wherein a patient may be located, including, but not limited to stretchers, operating tables, hospital or other beds, patient transfer equipment, such as snow sleds, helicopter floors and beds, stretcher boards and the like.

The present invention roller mattress has essentially a top sheet and a bottom sheet of flexible material that is capable of being selectively sealed together. It may be a single sheet folded over or two sheets or many sheets filled together, but the essential features are flexibility, sealability, inflatability and sufficient strength while inflated to support the weight of a human being.

The top sheet and bottom sheet are selectively sealed together to establish a set of parallel inflatable rollers, each roller having a pair of necked-down ends (portions with reduced diameters) and at least a pair of opposing, inflatable manifolds for delivery of inflation gas to each roller. The manifolds are disposed adjacent to and in gaseous contact with each end of the rollers. The rollers, the necked-down ends and the manifolds are all formed by sealing selected areas of the top sheet and the bottom sheet to one another. Thus, the top sheet and bottom sheet are pre-cut to establish the shapes of the aforesaid components or may be cut during or after heat sealing.

There is also at least one valve connected to at least one of the manifolds to permit inflation of the mattress and to retain inflation gas therein. Such valves are well within the skill of the artisan and may be one such as is typically used in air mattresses and rideable inflatable water devices.

FIGS. 1 through 6 inclusively show various views and details of one embodiment of the present invention inflatable patient transfer roller mattress.

Figure 1:
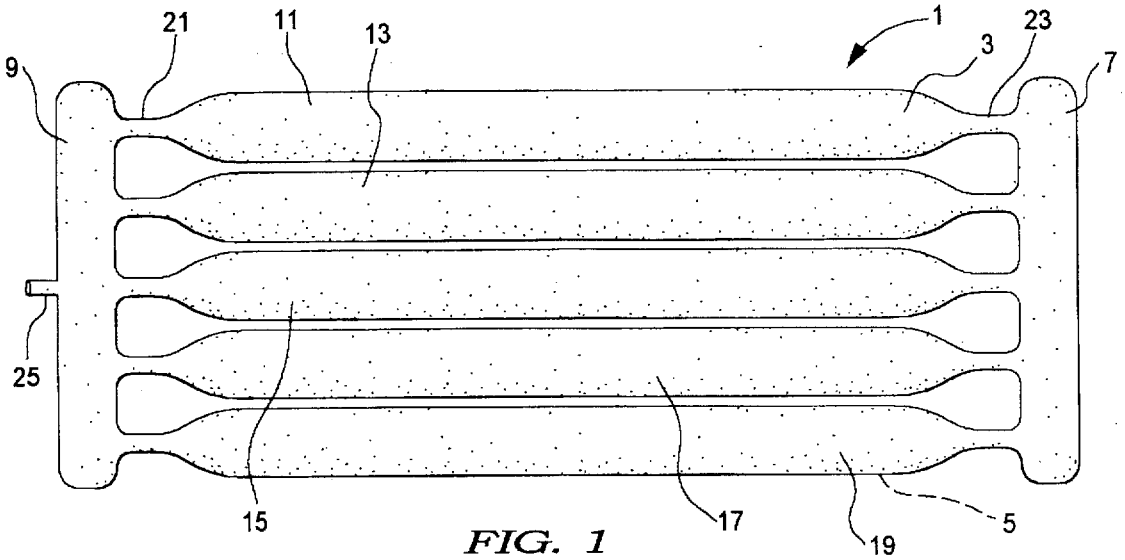
FIG. 1 illustrates a top view of one embodiment of the present invention transfer roller mattress in its deflated form and FIG. 2 illustrates the same mattress at a top, oblique view in inflated form.
Figure 2:
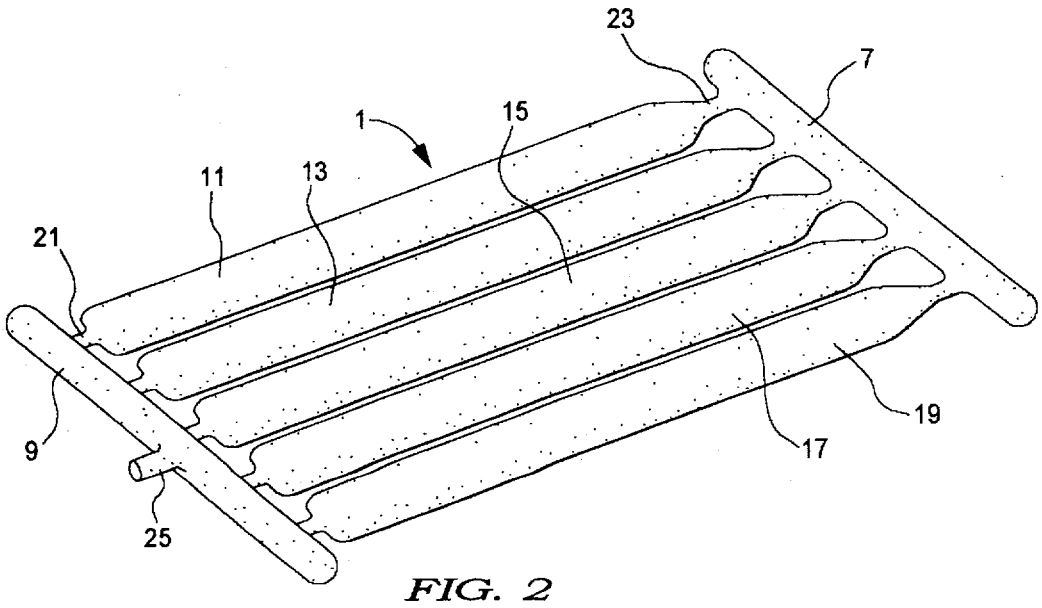

FIG. 1 shows a top view of present invention mattress one. Mattress 1 includes a plurality of inflatable rollers which is roller 11. There is a top sheet 3 and a bottom sheet 5 which has been heat-sealed together, said top sheet 3 and bottom sheet 5 having the configuration shown in top view FIG. 1. As a result of heat-sealed sheets, parallel inflater rollers 11, 13, 15, 17 and 19 are established. There are also a pair of opposing inflatable manifolds 7 and 9 which are adjacent to and in gaseous contact with each of the aforesaid rollers at their necked-down ends typified by ends 21 and 23 of roller 11. Thus, necked-down ends 21 connects roller 11 to manifold 9 and necked-down ends 23 connects roller 11 to manifold 7. There is also at least one valve and, in this case, only one valve, valve 25 which is connected to manifold 9 to permit inflation of all of the rollers and both manifolds into a semi-rigid state such that manifolds 7 and 9 maintain rollers 11, 13, 15, 17 and 19 in a spaced-parallel relationship, as shown in FIGS. 1 and 2. FIG. 2 shows a top oblique view of mattress 1 shown in FIG. 1 but inflated so that each of the rollers and manifolds have round, sausage-like shapes. Valve 25 in this case is the same as valves used for inflatable air mattresses and beach mattresses with a force-fit plug.

It should be noted that FIGS. 1 through 6 have identically parts identically numbered and each part need not be repeated for each figure.

Figure 3:
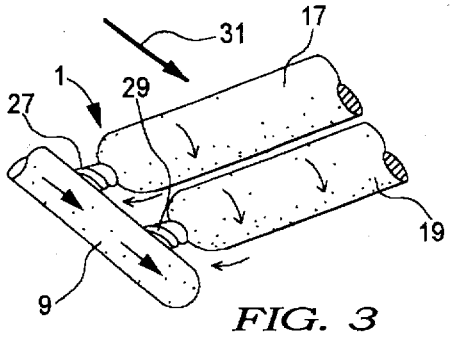
FIG. 3 illustrates a top, oblique view of a portion of the mattress shown in FIGS. 1 and 2 in its rolled out, twisted, necked-down ends.

FIG. 3 shows a top oblique partial view of mattress 1 including parts of rollers 17 and 19 with their respective necked-down ends 27 and 29. In FIG. 3, mattress 1 has been moved forward in the direction shown by arrows 31 and, as manifolds 7 and 9 have been moved forward in this direction, rollers 17 and 19 have rotated clockwise forwardly putting plural twists on necked-down ends 27 and 29. Thus, a patient or item resting on top of mattress 1 may be moved along the rollers for transfer from a first platform to a second platform.

Figure 4:
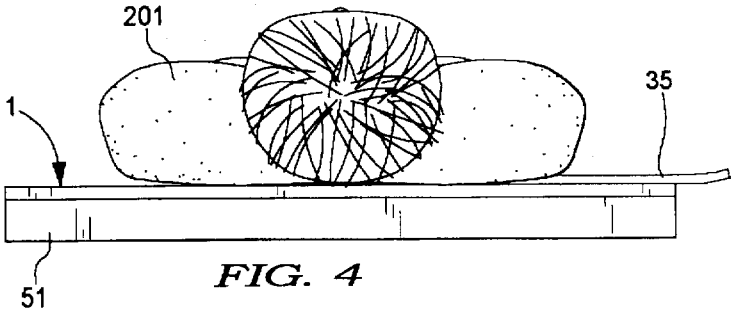
FIG. 4 illustrates an end view of a patient on a table with a deflated mattress of the foregoing figures.
Figure 5:
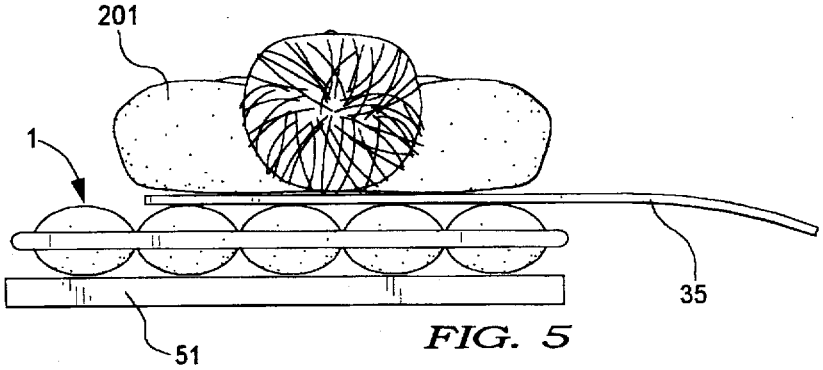
FIG. 5 illustrates same end view of FIG. 4, but with the present invention mattress inflated.
Figure 6:
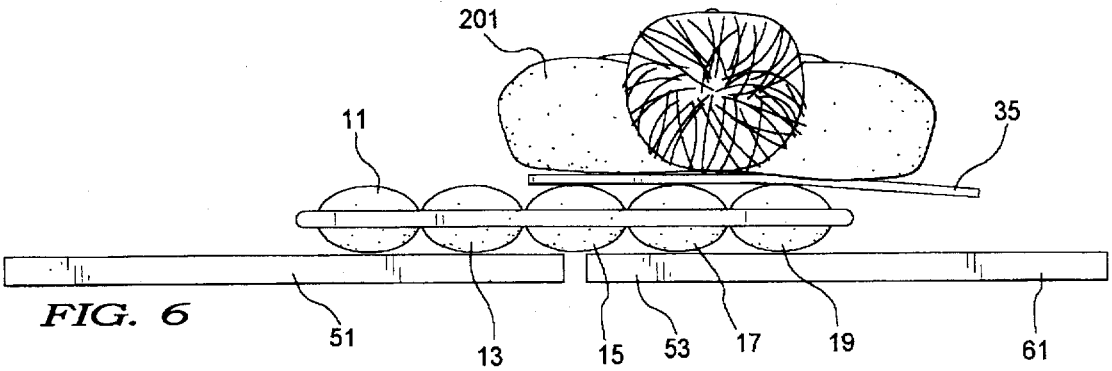
FIG. 6 illustrates an end view of the illustration shown in FIGS. 4 and 5 with the rollers being rotated and the patient being transferred from a table to a stretcher.

FIG. 4 shows an end view of a patient 201 on a table 51 with a present invention mattress 1 on table 51, placed under patient 201 and with a transfer sheet 35 located between the patient 201 and the mattress 1. Mattress 1 may be inflated such as by a foot pump or with a pressure cylinder so as to be in the inflated mode as shown in end view FIG. 5. End view FIG. 6 shows the table 51 adjacent to second table 53 and transfer sheet 35 is being pulled towards the right end 61 of table 53. Rollers 11, 13, 15, 17 and 19 rotate toward right end 61 of table 53 as shown to achieve transference of patient 201 from one platform to another, or, this case, from table 51 to table 53.

Figure 7:
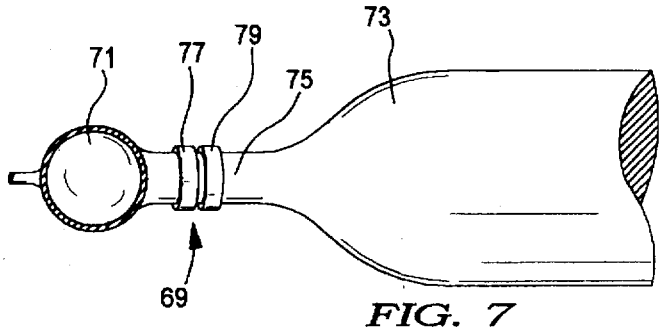
FIG. 7 illustrates a partial, cut front view of a roller and manifold of a present invention mattress which utilizes a rotational joint to prevent or reduce twisting.

FIG. 7 shows a partial, cut front view of a roller 73 and manifold 71 of a mattress which utilized an air-tight rotational joint 69. Joint 69 has sections 77 and 79 which are rotatable relative to one another but are air-tight. Section 77 is connected to necked-down end 75 upstream toward manifold 71 and section 79 is connected to necked-down end 75 toward roller 73. It should be seen that this would be more costly to make than mattress 1 shown in the above figures but should not be limited in the number to twists or rotations on the necked-down ends of the rollers.

Figure 8:
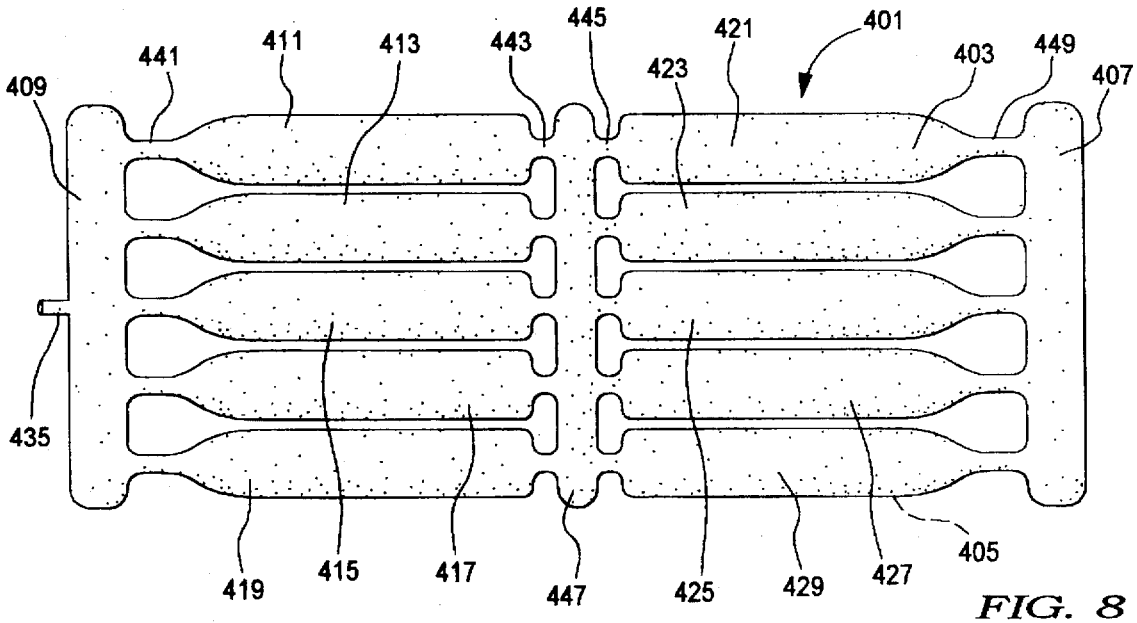
FIG. 8 illustrates a top view of a present invention mattress having three manifolds.

FIG. 8 shows an alternative present invention mattress 401 which includes a sealed together top sheet 403 and bottom sheet 405 formed so as to create two parallel sets of rollers. In this case, rollers 411, 413, 415, 417 and 419 on the left hand side and rollers 421, 423, 425, 427 and 429 on the right hand side. Mattress 401 has three manifolds, namely manifolds 407 and 409 and middle manifold 447. There are necked-down ends 441 and 443 for roller 411 and necked-down ends 445 and 449 for roller 421. There is an inflation valve 435.

Figure 9:
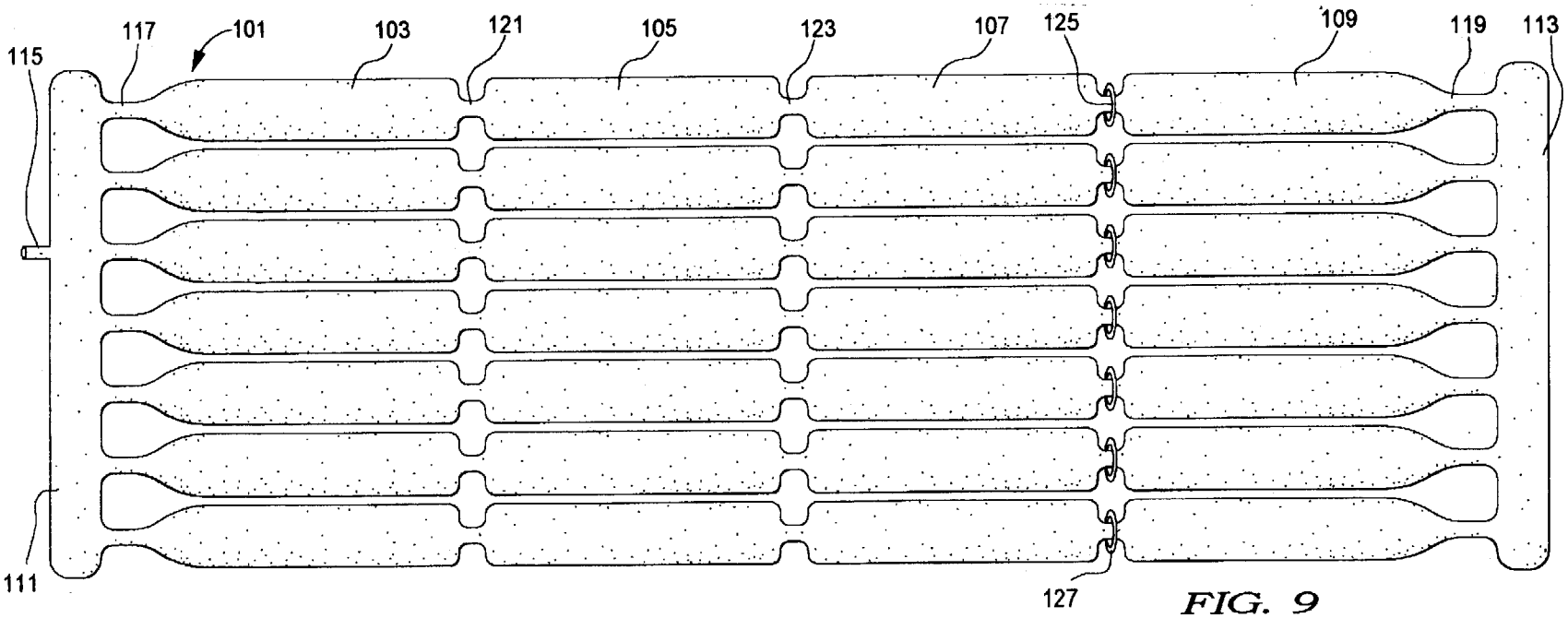
FIG. 9 illustrates a top view of a present invention mattress having more that two necked-down ends for each length of roller; and, FIG. 10 illustrates a top partial view of a section of roller for a present invention mattress having staggered, alternative roller sections and necked-down end sections.

FIG. 9 shows a top view of the present invention mattress 101 which includes a plurality of roller sections next to one another such as roller section 103, 105, 107 and 109. These respectively have necked-down ends 117, 121, 123, 125 and 119. There are also manifolds 111 and 113 with inflation valve 115. There are optional roller rings such as roller ring 127 which may be made of plastic or rubber to improve movement of mattress 101.

Figure 10:
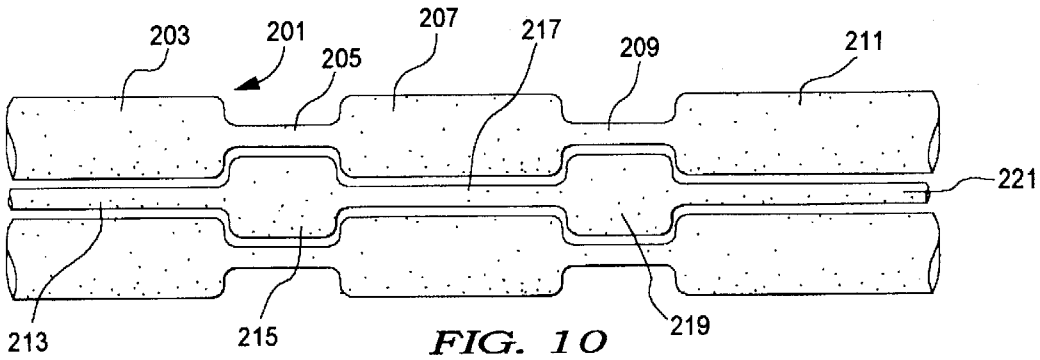

Referring now to FIG. 10, there is shown a top partial view of a section of rollers from a present invention mattress 301. It includes staggered alternative roller sections as an alternative embodiment. Thus, mattress 301 includes a first row of rollers 203, 207 and 211 and necked-down ends 205 and 209. Necked-down ends 205 and 209 have elongated portions such that the next row of rollers is aligned with the first row of necked-down ends and so forth alternating. Thus, in the second row, necked-down end 213 is adjacent to roller 203, roller 215 is adjacent to necked-down end 205, necked-down end 217 is adjacent to roller 207, roller 219 is adjacent to necked-down end 209 and necked-down end 221 is adjacent to roller 211.

Obviously, numerous modifications and variations of the present invention are possible in light of the above teachings. It is therefore understood that within the scope of the appended claims, the invention may be practiced otherwise than as specifically described herein.

What is claimed is:

1. An inflatable patient transfer roller mattress for moving a patient from a first platform to a second platform, which comprises:

a) a top sheet and a bottom sheet capable of being selectively sealed together;

b) a set of parallel inflatable rollers, each roller having a pair of necked-down ends for introduction of an inflation gas, the rollers being formed by sealing selected areas of the top sheet and the bottom sheet together;

c) at least a pair of opposing, inflatable manifolds for delivery of an inflation gas to each roller, each manifold being disposed adjacent to and in gaseous contact with each necked-down end of said rollers, the manifolds being formed by sealing selected areas of the top sheet and the bottom sheet together; and d) at least one valve connected to at least one of the manifolds to allow inflation of the manifolds and the rollers to an inflated, semi-rigid state such that the manifolds maintain the rollers in a spaced parallel relationship and the rollers become round such that an item resting on the top sheet on a first platform is lifted by the rollers and during movement of the item from a first platform to a second platform, the rollers revolving about the necked-down ends, which portions act as rotational pivots which rotate so as to minimize rolling resistance.

2. An inflatable patient transfer roller mattress as in claim 1, wherein each roller is at least about 24 inches in length, and each roller inflates to a diameter of at least about 3 inches.

3. An inflatable patient transfer roller mattress as in claim 2, wherein there are at least five rollers.

4. An inflatable patient transfer roller mattress as in claim 2, wherein the inflated length of said mattress at right angles to said rollers is at least about 18 inches.

5. An inflatable patient transfer roller mattress as in claim 2, wherein at least one additional, inflatable manifold is located between said pair of opposing, inflatable manifolds so as to divide each of said rollers into a row of segments, said at least one additional, inflatable manifold being gaseously connected to each of said rollers.

6. An inflatable patient transfer roller mattress as in claim 1, wherein there are at least five rollers.

7. An inflatable patient transfer roller mattress as in claim 1, wherein the inflated length of said mattress at right angles to said rollers is at least about 18 inches.

8. An inflatable patient transfer roller mattress as in claim 1, wherein spacing means is provided to space apart the top sheet and the bottom sheet in the necked-down ends so as to maintain gaseous contact between the rollers and the manifolds during the inflation process.

9. An inflatable patient transfer roller mattress as in claim 1, wherein the seals which form the sides of the rollers in the uninflated state are connected by tear seals which maintain adjacent rollers together in the uninflated state until the mattress is inflated at which time the tear seals break.

10. An inflatable patient transfer roller mattress as in claim 1, wherein the valve is a one-way valve having a quick connect/disconnect to allow quick inflation and sustaining of the mattress in the inflated state.

11. An inflatable patient transfer roller mattress as in claim 1, wherein each necked-down end is attached to the respective manifold by means of a gas tight swivel joint to reduce friction during rotation of the respective roller.

12. An inflatable patient transfer roller mattress which comprises:

a) a top sheet and a bottom sheet;

b) means for selectively sealing the top sheet and the bottom sheet in an air tight seam to form a plurality of parallel inflatable rollers;

c) means for inletting air to inflate the rollers;

d) the means for inletting connected to a means for distributing the air to the rollers; and e) means for maintaining the rollers in a spaced parallel relationship while allowing relatively free rotation of the rollers such that upon inletting air and distributing the air the rollers inflate and become relatively round, such that an item to be moved resting on the top sheet is lifted by the rollers and the means for maintaining allows the rollers to roll the item to the second location with a minimum of effort and discomfort to the user and to the item.

13. An inflatable patient transfer roller mattress as in claim 12, wherein each roller is at least about 24 inches in length, and each roller inflates to a diameter of at least about 3 inches.

14. An inflatable patient transfer roller mattress as in claim 12, wherein the inflated length of said mattress at right angles to said rollers is at least about 18 inches.

15. An inflatable patient transfer roller mattress as in claim 12, wherein spacing means is provided to space apart the top sheet and the bottom sheet in the necked-clown ends so as to maintain gaseous contact between the rollers and the manifolds during the inflation process.

* * * * *